US006111475A

United States Patent [19]

Giugni

[11] Patent Number: 6,111,475

[45] Date of Patent: Aug. 29, 2000

[54] HIGH FREQUENCY MULTI-PORT SWITCHING CIRCUIT

[75] Inventor: Steve Giugni, Marsfield, Australia

[73] Assignee: The Commonwealth of Australia Commonwealth Scientific and Industrial Research Organization, Campbell, Australia

[21] Appl. No.: 09/171,606

[22] PCT Filed: Mar. 5, 1998

[86] PCT No.: PCT/AU98/00141

§ 371 Date: Feb. 22, 1999

§ 102(e) Date: Feb. 22, 1999

[87] PCT Pub. No.: WO98/39812

PCT Pub. Date: Sep. 11, 1998

[30] Foreign Application Priority Data

Mar. 5, 1997 [AU] Australia ..... P05467

[51] Int. Cl.[7] ..... H01P 1/15; H01P 5/12

[52] U.S. Cl. ..... 333/103; 333/104

[58] Field of Search ..... 333/101, 103, 333/104; 370/460, 463

[56] References Cited

U.S. PATENT DOCUMENTS

| | | | |
|---|---|---|---|
| 4,129,838 | 12/1978 | Wallington et al. | 333/104 |
| 4,151,489 | 4/1979 | Berman et al. | 333/103 |
| 4,302,734 | 11/1981 | Stockton et al. | 333/104 |
| 5,757,249 | 5/1998 | Gabara et al. | 333/101 |

FOREIGN PATENT DOCUMENTS

| | | | |
|---|---|---|---|
| 260693 | 5/1970 | U.S.S.R. | 333/103 |
| 1259369 | 9/1986 | U.S.S.R. | 333/103 |
| 2121239 | 12/1983 | United Kingdom . | |

*Primary Examiner*—Paul Gensler
*Attorney, Agent, or Firm*—McDermott, Will & Emery

[57] ABSTRACT

This invention concerns a multi-port switching circuit which may operate at frequencies up to and even beyond 100 GHz. The invention may be implemented as a GaAs based monolithic microwave integrated circuit. The circuit comprises at least three ports arranged in a star configuration around a central ring. A single switching device is associated with each port. Each switching device is connected to two transmission lines to provide impedance matching and an interconnecting path around the ring. The transmission lines are initially chosen to have a length of a quarter wavelength at the center of the band of operation of the switch. The matching lines and the lines which form the interconnecting ring are then subject to an optimization procedures in which each pair of the switching devices is in turn modeled in their ON state which the remainder of the switching devices is modeled in their OFF state. The optimization procedure aims to achieve low transmission and insertion loss, while provide good isolation.

10 Claims, 3 Drawing Sheets

HIGH FREQUENCY MULTI-PORT SWITCHING CIRCUIT

TECHNICAL FIELD

This invention concerns a multi-port switching circuit. The embodiments of one realization may operate at frequencies around 60 GHz; but with appropriate devices embodiments may operate at other frequencies including higher frequencies up to and even exceeding 100 GHz.

BACKGROUND ART

Switching networks have been developed which operate at frequencies up to and exceeding 40 GHz. The switching elements in such networks use a combination of shunt passive FET devices and quarter-wave transformers, or combinations of series and shunt passive FET devices. Passive FET devices, in one type of switch, require bias to be applied to the gate and not between the source and drain. Broadband switches using a combination of active and passive switching elements have also been demonstrated.

SUMMARY OF THE INVENTION

The invention provides a multi-port switching circuit, comprising at least three ports, interconnected by transmission lines. The transmission lines are arranged with a central ring and outwardly extending arms. The ports are positioned at the ends of respective arms. The term "ring" has been used in a loose descriptive sense and does not necessarily imply circularity.

A switching device, such as a FET or HEMT, is associated with each port. The switching device is arranged between a first and a second transmission line. Each switching device may be arranged to shunt the main signal path of the circuit with its main current path extending between the junction of the first and the second transmission line, and signal ground. The first transmission line extends between the port and the switching device to provide impedance matching, and the second transmission line also provides impedance matching and a connecting path to the ring. The first and second transmission lines are initially chosen to have lengths of a quarter wavelength at the centre of the band of operation of the switch. The dimensions of the matching lines and the lines which form the connections to the ring are then determined using a procedure to optimize the performance of the circuit.

The optimisation procedure involves the selection of two of the ports as the input and output ports of the switching network. The switching devices associated with these ports are modelled by ON state representations. The other port, or ports, are isolated, and their associated switching devices are modelled in the OFF state. Optimisation of the transmission lines lengths and widths then aims to provide desired performance levels such as low transmission loss, good isolation at all other ports, low return loss or high power handling.

Other parameters such as gate width and length and substrate thickness may also be optimised, but these parameters are usually predetermined by selection of a particular fabrication process for the switching circuit.

The optimisation procedure continues by varying the signal flow in the circuit. That is, in the first step, the signals flow from a first port to a second port, with the other ports isolated; in the second step, signals flow from the second port to a third port with the other ports isolated. This process continues until a set of optimised parameters is established for each signal path configuration. The range of optimised parameters are then examined and a single best set of parameters is used to complete the design. The optimisation process uses conventional techniques and is able to take into account the effects of all the bends and discontinuities in the switch.

The optimisation provides similar switching performance between any pair of ports, independent of the chosen input and output.

The switching devices may be arranged symmetrically around the ring to simplify the optimisation process. However, symmetry is not a requirement.

HEMTs (High Electron Mobility Transistors) may be used to provide operation at high microwave frequencies. The choice of switching device influences, amongst other things, the power-handling capability of the circuit. Any switching device may be chosen. Two terminal devices, such as diodes including PIN-diodes; three terminal devices such as generic field effect devices, for example the FET, MOSFET, MESFET and HEMT; and multi-terminal devices, such as dual gate devices, could all be used.

Switching devices, such as HEMTs, may be modelled in their OFF state by a resistor and a capacitor in series, and in the ON state by a resistor and an inductor arranged in series. However, different and more complex models can be chosen.

Switching action may be achieved by biasing a pair of HEMTs in their ON state to create the signal path, while biasing all other HEMTs in their OFF state. Bias is applied to the gate terminals of the HEMTs, the drain terminal is connected to the junction between the first and second transmission lines, and the source terminal is grounded. The OFF or low impedance state is achieved by applying a DC voltage of zero volts to the gate terminal. The ON or high impedance state is achieved by applying a DC voltage slightly greater than that required to pinch the device off.

A feature of this circuit is that only a single switching device is required at each port as a result of optimizing the performance of the network for low losses and high isolation. Thus the switching circuit offers the benefit of providing a multi-port interconnection requiring an equal number of switching devices equal to the number of switched ports.

Embodiments of the multi-port switching circuit using HEMTs may operate in a frequency band around 60 GHz, and are able to provide all the usual switching functions, such as multiplexing at millimeter-wave (mm-wave) frequencies.

Switching networks embodying the invention may be used in multi-function circuits to allow functionality to be re-configured by altering the control voltages on the switching devices to re-route the signal.

A circuit containing an embodiment of the switching network may provide the ability to amplify a signal, up-conversion, down-conversion, or up and down conversion with amplification.

Circuits embodying the invention may offer redundancy that enables continued operation after failure of a circuit connected to the switching circuit. For instance, if a switching circuit was arranged to interconnect a number of identical circuits such as transmit channels, or receive channels, failure in any particular channel can be overcome by altering the control voltages on the switching circuit to re-route the signal path.

When the switching circuit is used to interconnect non-identical circuits, such as many transmit and receive circuits having different performance characteristics, then the switching circuit can be configured to use the transmit and receive circuits which have the most appropriate characteristics for the current conditions. For instance, if the transmit and receive circuits have performance characteristics which make them suitable for operation in different conditions then the switching circuit may be configured to use the transmit and receive circuits that are appropriate for the current conditions, and can be re-configured as conditions change.

Multiple cascades of individual networks can be connected together to create complicated routing networks. The robustness of the multiple port configuration allows for redundancy in the design of interconnections between systems.

BRIEF DESCRIPTION OF THE DRAWINGS

An example of the invention will now be described with reference to the accompanying drawings, in which.

BEST MODES FOR CARRYING OUT THE INVENTION

Figure 1:
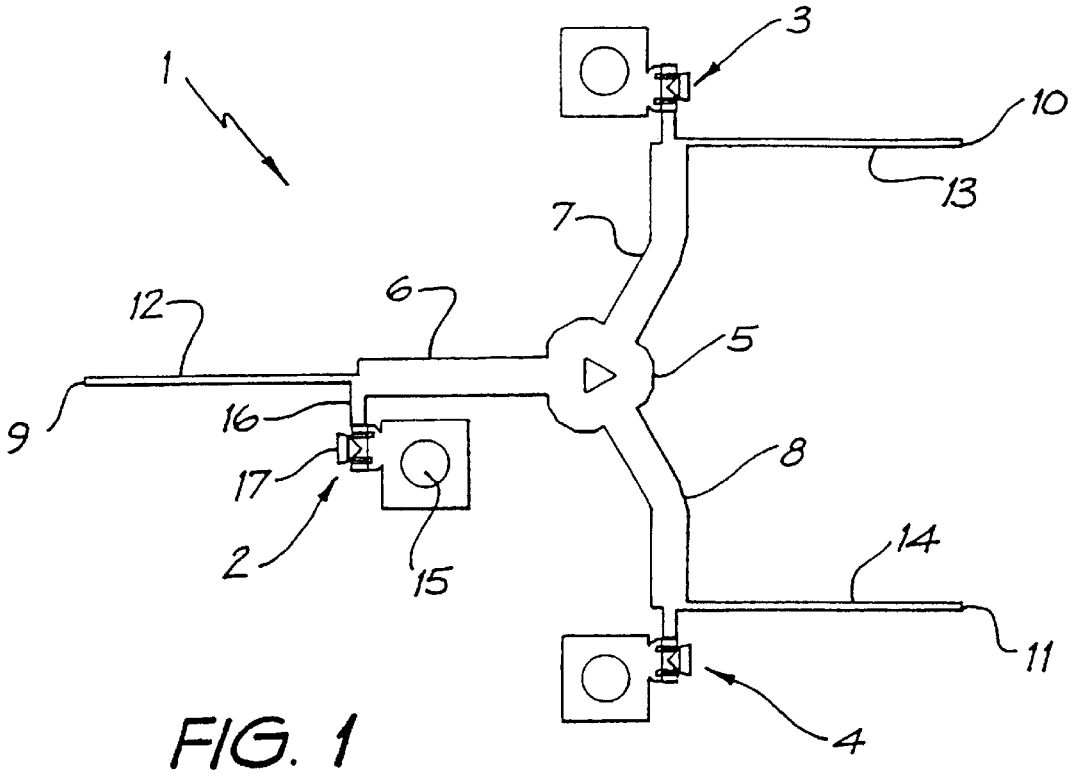
FIG. 1 is a layout of a three port switch embodying the invention.

Referring to FIG. 1, three port switch 1 comprises three transistors 2, 3 and 4 each connected to a central ring 5 by means of respective transmission lines 6, 7 and 8. The transistors 2, 3 and 4 are each associated with a respective external port 9, 10 and 11 by means of respective transmission lines 12, 13 and 14.

Transistor 2 has its source 15 at signal ground, its drain 16 connected to the transmission lines, and a gate 17. The terminals of transistors 3 and 4 have not been numbered, for the sake of brevity.

In normal operation two of the switches are turned ON to select the input and output ports.

Figure 2:
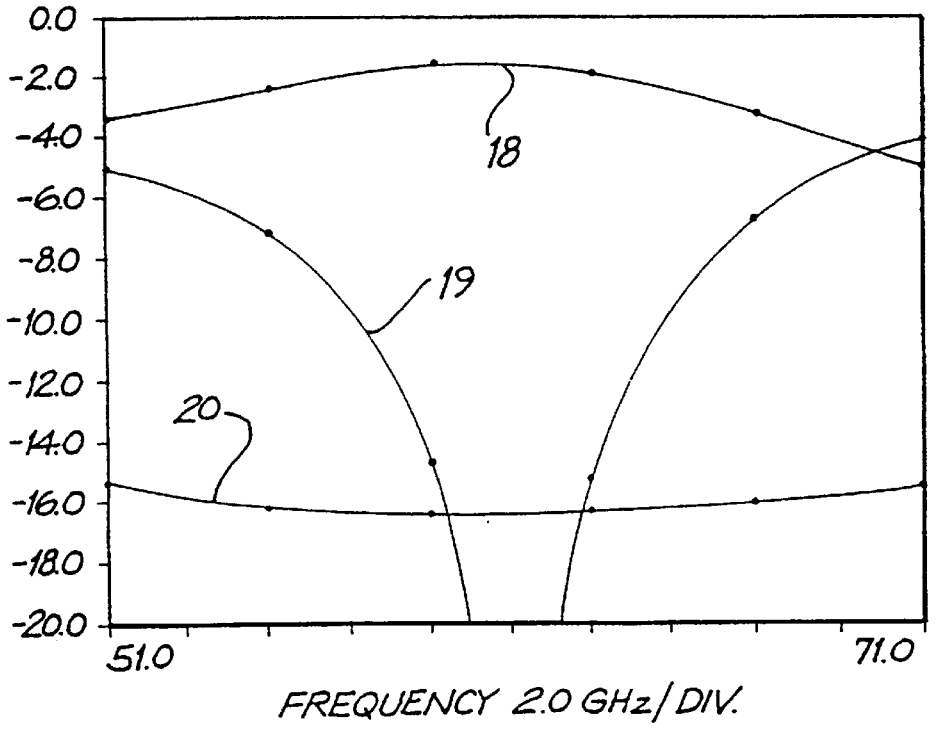
FIG. 2 is a graph showing the simulated signal response of the switching network of FIG. 1.

FIG. 2 shows the simulated magnitude responses when the switch is configured with input applied at port 9 and output taken from port 10; the magnitude responses for any two sets of ports is nominally identical.

Curve 18 shows the simulated loss from the input port 9 to the output port 10 to be less than 2 dB at the center frequency of 61 GHz, and to remain less than 3 dB between 54 to 66 GHz. Curve 19 which shows the input match to be better than 20 dB at the centre frequency and remains good over a wide bandwidth; that is greater than 10 dB over 8 GHz of bandwidth. Curve 20 shows the isolation between the input port 9 and the isolated OFF port 11 to be better than 16 dB.

Figure 3:
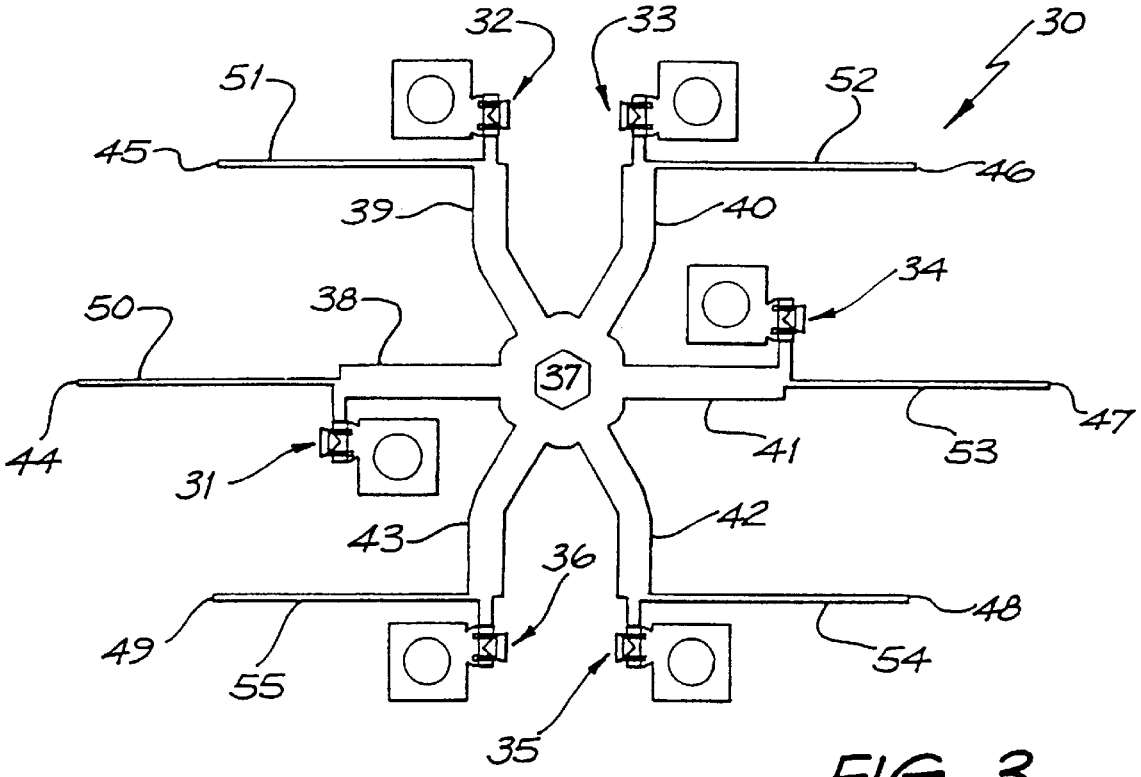
FIG. 3 is a layout of a six port switch embodying the invention.

Referring to FIG. 3, six port switch 30 comprises six HEMTs 31, 32, 33, 34, 35 and 36 arranged around a central ring 37. Each of the transistors is connected to the ring 37 by respective lengths of transmission line 38, 39, 40, 41, 42 and 43. The external connection ports 44, 45, 46, 47, 48, and 49 are connected to respective HEMTs by transmission lines 50, 51, 52, 53, 54 and 55. The transmission lines provide impedance matching, for both the signal transmission path and the isolated ports.

Figure 4:
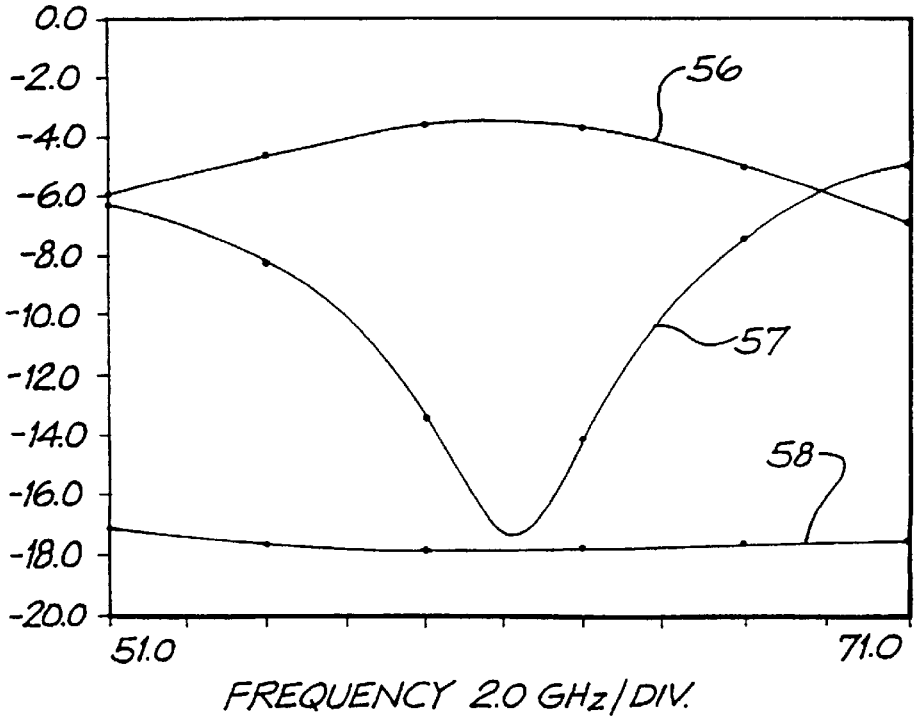
FIG. 4 is a graph showing the simulated response of the switching network of FIG. 3.

FIG. 4 shows the simulated magnitude response when the switch is configured with input applied at port 44 and output from port 47; the magnitude responses for any two sets of ports is nominally identical.

Curve 56 shows the simulated loss from the input port 44 to the output port 47 is just over 3 dB at the center frequency of 61 GHz, and remains less than 4 dB between 57 to 66 GHz. Curve 57 shows the input match is better than 15 dB and remains good over a wide bandwidth; that is greater than 10 dB over 8 GHz of bandwidth. Curve 58 shows the isolation between the input port 44 and any of the OFF ports is better than 16 dB.

Figure 5A:
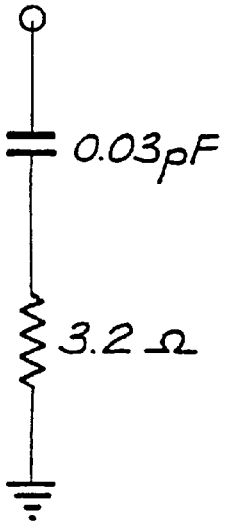
FIG. 5(*a*) is an OFF state model of a HEMT that may be incorporated into a switch embodying the invention, and FIG. 5(*b*) is an ON state model corresponding to FIG. 5(*a*).
Figure 5B:
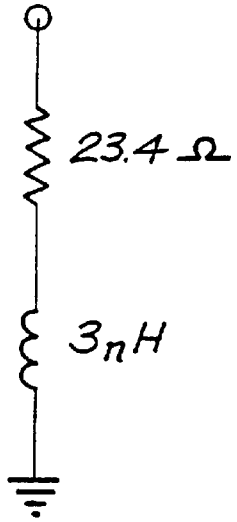

FIG. 5 shows the bi-state model of the two finger, fifty micrometer (i.e., 2 by 25 $\mu$m fingers) wide HEMT used in this embodiment. In the OFF state shown in FIG. 5(*a*) the HEMT is biased at zero volts. In this state the HEMT is represented by a 3.2 ohm resistor and a 0.03 picoFarad capacitor arranged in series. In the ON state shown in FIG. 5(*b*), the HEMT is biased slightly beyond pinch-off. In this state the HEMT is represented by a 23.4 ohm resistor and a 3 nanoHenry inductance arranged in series.

The switch is optimized using the bi-state model for a stated set of performance parameters in order to produce the required performance. Any of the parameters can, of course, be traded against other parameters to achieve different levels of performance that may be required by different applications; for instance input match could be traded against power handling capability. If the circuit were connected to a number of different circuits having different performance characteristics then it could be optimised accordingly.

Although the invention has been described with reference to a particular embodiment, it should be appreciated that the invention could be embodied in many other forms. For instance, there is no limit on the number of ports which can form the switching network, symmetry is not a requirement for the operation of the network, and operation is not limited to particular process technologies or geometries for the active devices. Besides GaAs fabrication technology the invention is applicable to Si and InP processes, among others.

Although this invention has been described with reference to a switching circuit which operates at about 61 GHz and it is believed to be useful at much higher frequencies, it should also be understood that the invention may be useful in lower frequency switches.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A multi-port switching circuit, comprising:

at least three input/output ports interconnected by transmission lines, the transmission lines being arranged with a central ring and outwardly extending arms, each arm including first and second transmission lines with the ports being positioned at ends of a respective first transmission line of a corresponding arm;

a switching device associated with each port, each switching device being arranged between a junction of the respective first and second transmission lines of the corresponding arm, with each respective first transmission line extending between the corresponding port and the associated switching device to provide impedance matching, and the second transmission line providing impedance matching and a connecting path to the central ring.

2. The multi-port switching circuit according to claim 1, wherein each switching device associated with each port is a single switching device.

3. The multi-port switching circuit according to claim 2, wherein the single switching device associated with each port is arranged to shunt a main signal path of the circuit with a main current path of the switching device extending between the junction of the first and second transmission lines, and ground.

4. The multi-port switching circuit according to claim 1, wherein the switching devices are HEMTs.

5. The multi-port switching circuit according to claim 1, wherein the switching devices are arranged symmetrically around the ring.

6. The multi-port switching circuit according to claim 1, wherein dimensions of the matching lines and the lines which form the connections to the ring optimize the performance of the circuit.

7. The multi-port switching circuit according to claim 4, wherein each HEMT includes a drain terminal, source terminal and a gate terminal, a pair of HEMTs is in an ON state to create a signal path with each of the ON state pair of HEMTs having the respective drain terminals connected to the junction between the corresponding first and second transmission lines, the respective source terminals grounded, and a DC voltage applied to the respective gate terminals, said DC voltage being slightly greater than that required to pinch off each HEMT of the pair of HEMTs; and all remaining HEMTs are in the OFF or low impedance state with a DC voltage of zero volts applied to the respective gate terminals.

8. In a multi-port switching circuit having at least three input/output ports interconnected by transmission lines, the transmission lines being arranged with a central ring and outwardly extending arms, each arm including first and second transmission lines with the ports being positioned at ends of a respective first transmission line of a corresponding arm, and a switching device associated with each port, each switching device being arranged between a junction of the respective first and second transmission lines of the corresponding arm, with each respective first transmission line extending between the corresponding port and the associated switching device to provide impedance matching, and the second transmission line providing impedance matching and a connecting path to the central ring, a procedure for optimizing dimensions of the matching lines and the lines which form the connections to the ring for selected performance parameters of the circuit, the performance parameters being selected from a list of performance parameters consisting of low transmission loss, good isolation at isolated ports, low return loss and high power handling, said procedure comprising the steps of:

selecting two of the ports as the input and output ports of the switching network and providing a signal path configuration;

modeling the switching devices associated with the selected first and second ports by ON state representations;

isolating the remaining ports by modeling their associated switching devices in an OFF state; and adjusting the transmission lines lengths and widths to achieve the selected performance parameters.

9. The procedure according to claim 8, further comprising the steps of:

varying the signal flow in the circuit including selecting another two ports as the input and output ports of the switching circuit by modeling the switching devices associated with the selected other two ports in the ON state with the remaining ports isolated by modeling their associated switching devices in the OFF state, each of the selected other two ports providing a signal path configuration which is different from any other signal path configuration provided by any previously selected two ports;

continuing varying the signal flow until a set of optimized dimensions of the matching lines and the lines which form the connections to the ring for the selected performance parameters are established for each signal path configuration; and examining the range of optimized dimensions of the matching lines and the lines which form the connections to the ring for selected performance parameters and using a single optimized dimensions of the matching lines and the lines which form the connections to the ring for selected performance parameters to complete the design.

10. The procedure according to claim 9, wherein the switching devices are modeled in their OFF state by a resistor and a capacitor in series, and in their ON state by a resistor and an inductor arranged in series.

* * * * *